United States Patent [19]

Nolin

[11] Patent Number: 4,605,026

[45] Date of Patent: Aug. 12, 1986

[54] COMB FOR DISPENSING TREATMENT SOLUTION TO HAIR

[76] Inventor: Rosemary D. Nolin, 9935 Marigold La., Duluth, Minn. 55810

[21] Appl. No.: 482,668

[22] Filed: Apr. 6, 1983

[51] Int. Cl.[4] ..... A45D 24/22

[52] U.S. Cl. ..... 132/112

[58] Field of Search ..... 132/112–114, 132/9, 111, 150

[56] References Cited

U.S. PATENT DOCUMENTS

| | | | |
|---|---|---|---|
| 841,175 | 1/1907 | Phinney | 132/114 |
| 859,711 | 7/1907 | Winsor | 132/114 |
| 1,137,792 | 5/1915 | Scheel | 132/112 |
| 1,525,106 | 2/1925 | Smythe | 132/112 X |
| 2,128,183 | 8/1938 | Hickey | 132/111 |
| 2,376,065 | 5/1945 | Kuszyk | 132/114 |
| 2,922,425 | 1/1960 | Lerner et al. | 132/112 X |
| 3,059,652 | 10/1962 | Thomas | 132/112 |
| 3,147,757 | 9/1964 | Hofmann | 132/114 |
| 3,457,928 | 7/1969 | Kurshenoff | 132/113 |

FOREIGN PATENT DOCUMENTS

| | | | |
|---|---|---|---|
| 3013769 | 10/1981 | Fed. Rep. of Germany | 132/112 |

*Primary Examiner*—Gregory E. McNeill

*Attorney, Agent, or Firm*—Peterson, Wicks, Nemer & Kamrath

[57] ABSTRACT

A comb for dispensing treatment solution to hair is disclosed according to the teachings of the present invention as including an elongated frame member. Groups of a plurality of teeth extend generally perpendicular to the frame member and are generally spaced from each other creating gaps therebetween. In the preferred embodiments of the present invention, trough shaped members are formed in the frame member in the gaps for separating and capturing strands of hair desired to be treated, for receiving and forming pools of hair treatment solution, and for allowing hair to be pulled through the pools of hair treatment solution. In one of the preferred embodiments of the present invention, the comb further includes a tooth formed in each of the gaps which includes a trough continuation member for enhancing the function of the troughs formed in the frame member. The comb further includes a spiked member attached to the first end of the frame member for picking up, raising, and/or separating the hair from the scalp. The comb further includes a handle portion which extends at an angle from the second end of the frame member to be in an angular relation to the teeth of the comb. In its most preferred form, the comb further includes a fluid conduit formed interiorly of the frame member including passageways in fluid communication with the troughs and wherein the handle portion includes a squeeze type bottle in fluid communication with the fluid conduit.

17 Claims, 5 Drawing Figures

COMB FOR DISPENSING TREATMENT SOLUTION TO HAIR

BACKGROUND AND SUMMARY

The present invention relates generally to devices for applying treatment solutions such as dyes, tints, bleaches, wave set solutions, and the like to hair; more particularly to combs, and specifically to combs for dispensing treatment solutions to hair.

Various hair treatments require that treatment solution be applied to selected strands of hair. Such treatments include color shading of hair, highlighting, "streaking", and like hair treatments. Various devices have been available to the public; however, such devices have not been accepted by the trade. Generally, such devices were expensive to manufacture and were clumsy to operate. Furthermore, generally they tended to feed the solution either too rapidly or too slowly, or to deliver it unevenly, or they may be subject to still other disadvantages.

The present invention solves these and other problems in dispensing treatment solutions to hair by providing, in the preferred embodiment, a comb including an elongated frame member. The comb further includes groups of a plurality of teeth extending from the frame member spaced from each other creating gaps therebetween. A handle portion is provided according to the teachings of the present invention extending from the first end of the frame member. Troughs are formed in the frame member in the gaps between the groups of teeth for separating and capturing strands of hair desired to be treated, for receiving and forming pools of hair treatment solution, and for allowing hair to be pulled through the pools of hair treatment solutions.

It is thus an object of the present invention to provide a comb for dispensing treatment solution to hair.

It is further an object of the present invention to provide such a novel comb having a novel handle portion which extends from the frame member in the plane of the teeth and at an angle less than 90 degrees in the direction of the teeth.

It is further an object of the present invention to provide such a novel comb for dispensing treatment solution which gives uniform application of the treatment solution to the hair at the desired rate.

It is further an object of the present invention to provide such a novel comb for dispensing treatment solution which is simple to manufacture, can be readily made of standard material utilizing conventional formation processes, and which is simple to operate.

These and further objects and advantages of the present invention will become clearer in the light of the following detailed description of the illustrative embodiments of this invention described in connection with the drawings.

DESCRIPTION OF THE DRAWINGS

The illustrative embodiments may best be described by reference to the accompanying drawings where.

Figure 1:
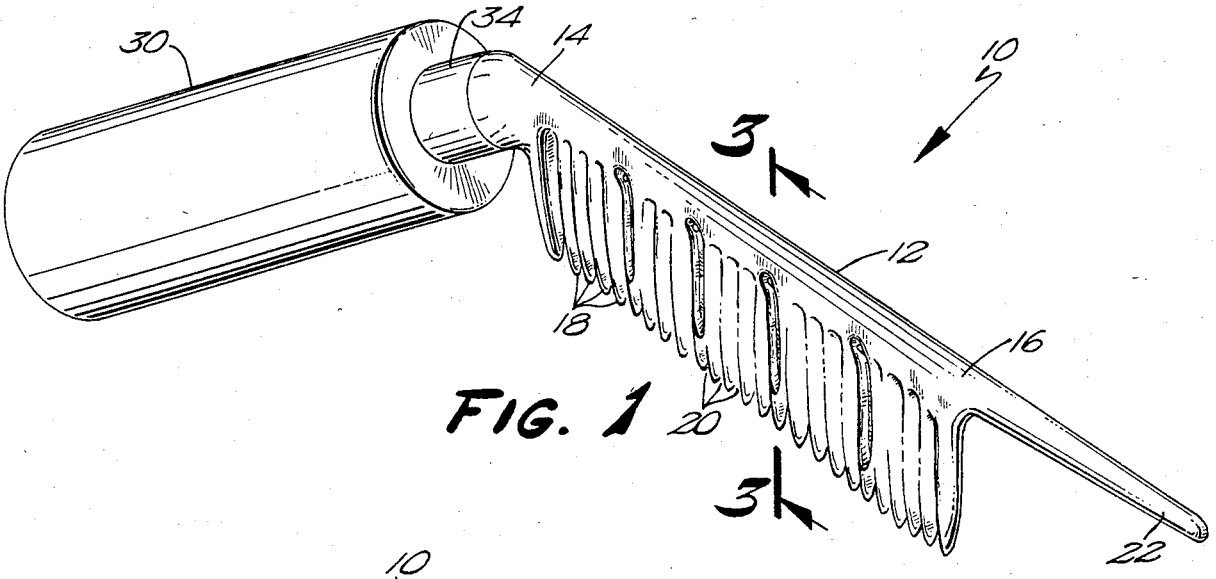
FIG. 1 shows a perspective view of a comb according to the teachings of the present invention.

All figures are drawn for ease of explanation of the basic teachings of the present invention only; the extensions of the figures with respect to number, position, relationship, and dimension of the parts to form the preferred embodiments will be explained.

Where used in the various figures of the drawings, the same numerals designate the same or similar parts in the combs. Furthermore, when the terms "first", "second", "ends", "bottom", "top", and similar terms are used herein, it should be understood that these terms have reference only to the structure shown in the drawings as it would appear to a person viewing the drawings and are utilized only to facilitate describing the invention.

DESCRIPTION

A color shading hair comb according to the teachings of the present invention is shown in the drawings and generally designated 10. Comb 10 includes a longitudinal frame member or back 12 corresponding generally in outer shape with the back of an ordinary comb. Frame member 12 includes a first end 14 and a second end 16. Further provided are a plurality of teeth 18 of more or less conventional outer shape projecting from frame member 12. In the preferred form, teeth 18 are located in groups of three or more, with gaps or spaces 20 being formed between the groups of teeth 18. In its most preferred form, the width of gaps 20 is twice the width of teeth 18 plus twice the width of spacing 21 between teeth 18 in the groups of teeth 18.

For purposes of picking up, raising, and/or separating hair from the scalp, member 22 is provided. Member 22 in its preferred form is an elongated spike or tooth shaped member which extends from first end 14 of frame member 12. In its most preferred form, member 22 is shown as a continuation of frame member 12 beyond end 14 and is commonly referred to as a rat tail. Further, in its most preferred form, frame member 12 and member 22 are shown as being generally straight.

According to the teachings of the present invention, at least a portion of frame member 12 is hollow and forms an internal fluid conduit 24 therein. Further provided are fluid passageways 26 formed in the frame member 12 and which intersect with conduit 24. Passageways 26 are in fluid communication or contact with the hair and terminate in frame member 12 in gaps 20.

Comb 10 further includes in the preferred embodiment of the present invention a handle portion 28 attached to second end 16 of frame member 12. Handle portion 28 is shown in its most preferred form as being located generally in the same plane as teeth 18 and frame member 12. Further, portion 28 extends at an angle to frame member 12 in the direction of teeth 18 in the preferred form of the present invention. Specifically in the preferred embodiment, handle portion 28 is generally at a 45 degree angle to teeth 18.

In its most preferred form, handle portion 28 includes a bottle 30 have male threaded portion 32 and a female threaded portion 34 formed on end 16 of frame member 12. Fluid conduit 24 is in fluid communication with the interior of bottle 30. Suitable provisions for forcing fluid from the interior of bottle 30 into conduit 24 is provided such as having bottle 30 include flexible sides for allowing squeezing by the operator of comb 10.

According to the teachings of the present invention, comb 10 further includes members 36 for separating and capturing strands of hair desired to be treated, for receiving and forming pools of hair treatment solution, and for allowing hair to be pulled through the pools of hair treatment solution. In its most preferred form, members 36 are trough shaped members 38 formed in frame member 12 into which passageways 26 terminate. In its most preferred form, troughs 38 have a width generally equal to twice the width of teeth 14 and are centered in gap 20. To enhance the introduction and capturing of strands of hair into trough 38, troughs 38 have a generally parabolic shape in the plane of teeth 18 as best seen in FIG. 1, with the closed end portion extending into frame member 12 and the open end portion extending in the direction of teeth 14. To enhance the hair treatment pool formation ability, troughs 38 are dish shaped in a plane generally perpendicular to the longitudinal axis of frame member 12 as best seen in FIGS. 3 and 5.

Figure 2:
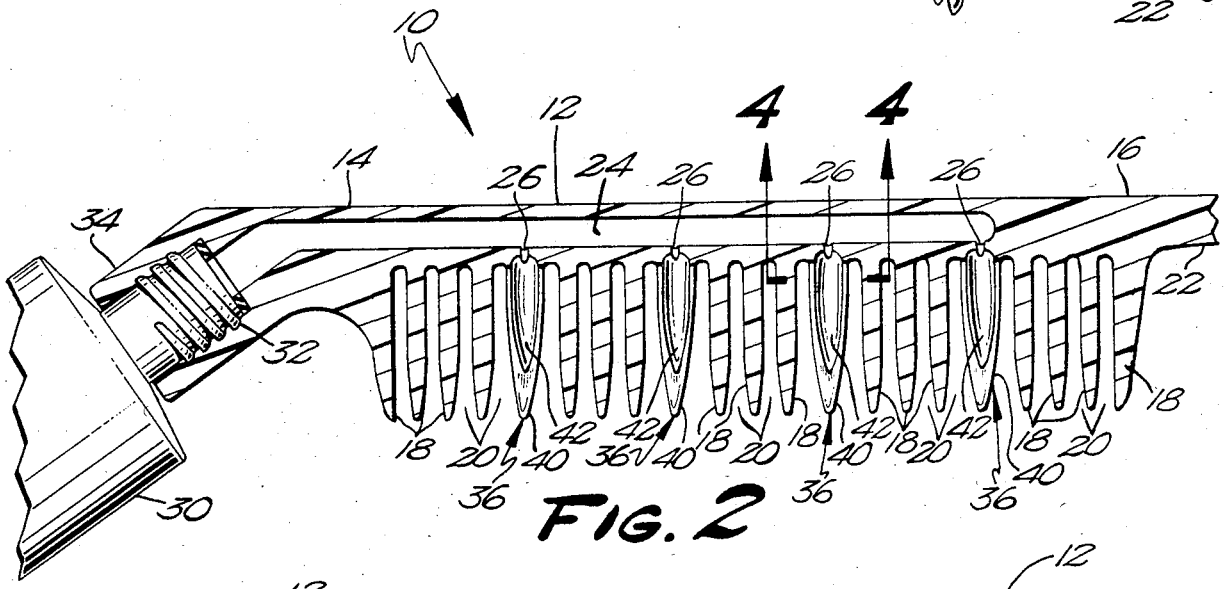
FIG. 2 shows a partial, cross sectional view of the comb of FIG. 1.
Figure 4:
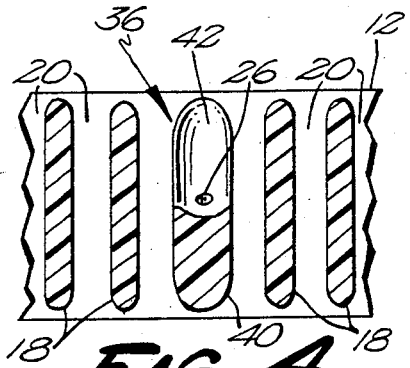
FIG. 4 shows a partial, cross sectional view of the comb of FIG. 1 according to section line 4—4 of FIG. 2.
Figure 5:
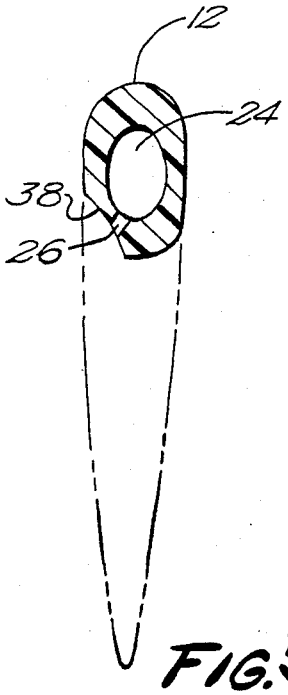
FIG. 5 shows a cross sectional view of another embodiment of a comb according to the teachings of the present invention.

It should then be appreciated that members 36 can utilize troughs 38 alone as shown in one of the preferred embodiments of the present invention in FIG. 5 or can utilize troughs 38 with other hair separating and capturing and solution pooling and dispersing assisting structure. For example, such assisting structure is shown in a preferred form in FIGS. 1–4 in another of the preferred embodiments of the present invention as specially shaped teeth 40 which project from frame member 12 in gaps 20. Specifically, teeth 40 have a width generally equal to twice the width of teeth 18 as best seen in FIGS. 2 and 4 and have a length which is generally equal to the length of teeth 18 as best seen in FIGS. 1–3. As best seen in FIG. 4, the bottom surface of teeth 40 is generally at the same level as the bottom surface of teeth 18. Teeth 40 are generally centered in gaps 20.

Figure 3:
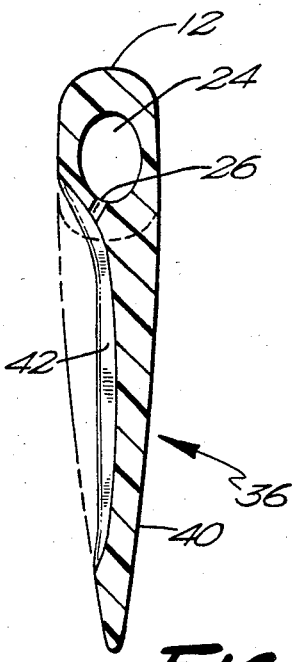
FIG. 3 shows a cross sectional view of the comb of FIG. 1 according to section line 3—3 of the FIG. 1.

In the preferred embodiment of the present invention, teeth 40 have a height or thickness at their attachment to frame member 12 which is generally equal to one half the height or thickness of teeth 18 at their attachment to frame member 12 as best seen in FIGS. 3 and 4. In their most preferred form, teeth 40 have a generally constant height throughout their length and taper at their end portion in conformance with the end portions of teeth 18, whereas teeth 18 have a generally tapering shape throughout their substantial length as best seen in FIG. 3. It should then be appreciated that the preferred shape and size of teeth 40 and their relationship to teeth 18 provides several advantages including the advantageous separation and capturing of the desired size of hair strands.

Teeth 40 further include a trough continuation member 42 according to the teachings of the present invention. To enhance the introduction and capturing of strands of hair, trough continuation members 42 in their most preferred forms have a generally angular shape in the plane of teeth 18 as best seen in FIG. 2, with the point being adjacent to but spaced from the points of teeth 40 and the open end extending toward frame member 12 and terminating contiguously in trough 38. To enhance their hair treatment pool formation ability, members 42 in their most preferred forms are dish shaped in a plane generally perpendicular to the longitudinal axis of frame member 12 as best seen in FIGS. 3 and 4.

Prior to the present invention, various methods and devices have been available for applying treatment solutions to hair. These devices included combs or brushes including conduits located and extending through the entire length of the teeth, wick like members or bristles for dispersing treatment solution to the hair, and like structure. However, such devices did not give a uniform application of the solution to the hair. For example, such devices did not insure that the treatment solution was applied to only selected strands of hair but rather allowed the treatment solution to be applied on adjacent strands of hair and otherwise suffered from other disadvantages. Thus, such devices have not been accepted in the industry as failing to give satisfactory results.

Current methods for providing this type of hair treatment include the placement of a plastic cap on the head and selected strands were pulled through openings in the cap and treated by the desired solution. Of course, this is a slow and painful procedure since the hair is physically pulled through the cap. An alternate method of this type of hair treatment includes the weaving of strands of hair and the application of hair treatment solution to portions of the woven strands. The treated hair was then placed in packets for processing and these steps were repeated for all hair desired. Likewise, another method of this type of hair treatment includes the selection of hair strands which were treated with hair solution and then wrapped in tin foil for processing. Furthermore, an alternate method of this type of hair treatment includes the application of hair treatment solution to a comb which was then applied to selected areas of the hair in a painting type technique. It can then be appreciated that these methods are also very slow, tiring for the operator, and expensive to the consumer and may not give satisfactory results.

Utilizing comb 10 of the present invention, treatment solution can be rapidly and uniformly applied to selected portions of the hair. Specifically, in use, member 22 may be inserted into the hair for picking up, raising and/or separating the desired hair strands from the scalp. The hair may then be slid on the outside of member 22 and frame member 12 with comb 10 positioned such that teeth 40 and/or 18 do not engage with the hair but rather that the hair merely slides on members 12 and 22. When comb 10 is in the desired position, comb 10 may then be rotated such that teeth 40 and/or teeth 18 engage with, pass through, and thus separate the hair portions, with members 42 and/or troughs 38 being located in an upper position. It should then be appreciated that the hair located between teeth 18 is then separated from the hair located in gaps 20 and thus is also separated from the hair treatment solution.

At that time, comb 10 may be pulled through the hair such that the hair strands located in gap 20 are pulled through members 42 and/or troughs 30. Simultaneously, treatment solution is forced through conduit 24 and passageways 26 into troughs 38 for forming pools therein. In the preferred embodiment, this is accomplished by the gradual squeezing of bottle 30. It should then be appreciated that due to the preferred construction of teeth 40 and troughs 38, the hair strands located in gap 20 receive a uniform application of treatment solution. Furthermore, due to the angular relation of handle portion 28 with teeth 18, comb 10 according to the teachings of the present invention can be easily utilized as set forth hereinbefore. Thus, hair treatment can be easily, rapidly, and uniformly applied utilizing comb according to the teachings of the present invention.

It should then be appreciated that comb 10 can be provided having differing numbers of teeth 18 in the groups of teeth 18. Thereby, the amount of hair located in gaps 20 to which the hair treatment solution is applied will vary according to the number of teeth 18. Thus, combs 10 having a desired number of teeth 18 in their grouping can be utilized according to the particular hair treatment desired and/or the location of the hair being treated on the scalp. It should then be appreciated that the construction of comb 10 according to the teachings of the present invention provide advantageous separation of uniform sizes of hair strands as set forth hereinbefore.

Now that the basic teachings of the present invention have been explained, many extensions and variations will be obvious to one having ordinary skill in the art. For example, combs 10 according to the teachings of the present invention utilize several unique, novel, and advantageous features which can be utilized together, separately, and/or with other hair treating constructions. However, a total comb utilizing the present invention is preferred.

Thus, since the invention disclosed herein may be embodied in other specific forms without departing from the spirit or general characteristics thereof, some of which forms have been indicated, the embodiments described herein are to be considered in all respects illustrative and not restrictive. The scope of the invention is indicated by the appended claims, rather than by the foregoing description, and all changes which come within the meaning and range of equivalency of the claims are intended to be embraced therein.

What is claimed is:

1. Comb for dispensing treatment solution to hair comprising, in combination: an elongated frame member having a first end and a second end; groups of a plurality of teeth extending generally perpendicular to the longitudinal axis of the frame member, with the groups of teeth being spaced from each other creating gaps therebetween, with the width of the gap being generally equal to twice the width of the teeth and twice the spacing of the teeth in the plurality of teeth; means formed in the gaps between the groups of teeth for separating and capturing strands of hair desired to be treated, for receiving and forming pools of hair treatment solution, and for allowing hair to be pulled through the pools of hair treatment solution comprising troughs formed in the frame member, with the width of the troughs being generally equal to twice the width of the teeth; a squeeze bottle for storing hair treatment solution; means for attaching the bottle to the first end of the frame member to form a handle portion, with the handle portion being located generally in the same plane as the teeth and the frame member and extending at an angle from the first end of the frame member in the direction that the teeth extend away from the frame member, and with the handle portion being at an angle to the teeth which is generally at a 45 degree angle to the teeth; means for introducing hair treatment solution from the squeeze bottle into the troughs for application to the hair separated and captured in the gaps between the groups of teeth while leaving the hair located in the groups of teeth and not within the gaps free of the application of hair treatment solution comprising a fluid conduit located internally of the frame member and fluid passageways extending between the troughs and the fluid conduit for providing fluid communication between the troughs and the fluid conduit, with the squeeze bottle being in fluid communication with the fluid conduit and allowing treatment solution to be forced into the fluid conduit and fluid passageway by squeezing the squeeze bottle; and an elongated spike shaped member formed as a continuation of the frame member beyond its second end for picking up, raising, and/or separating hair from the scalp.

2. The comb of claim 1 further comprising, in combination: teeth extending generally perpendicular to the frame member and located generally centrally of the gap between the groups of teeth for assisting the hair separation and capturing, solution pooling, and dispersing means, with the assisting teeth including trough continuation members in fluid communication with the troughs for enhancing the hair treatment pool formation ability.

3. Comb for dispensing treatment solution to hair comprising, in combination: an elongated frame member having a first end and a second end; groups of a plurality of teeth extending generally perpendicular to the longitudinal axis of the frame member, with the teeth having a length, a width, and a height, with the groups of teeth being spaced from each creating gaps therebetween; a handle portion extending from the first end of the frame member; means formed in the gaps between the groups of teeth for separating and capturing strands of hair desired to be treated, for receiving and forming pools of hair treatment solution, and for allowing hair to be pulled through the pools of hair treatment solution comprising troughs formed in the frame member; and means for introducing treatment solution into the troughs for application to the hair separated and captured in the gaps between the groups of teeth while leaving the hair located in the groups of teeth and not within the gaps free of the application of treatment solution.

4. The comb of claim 3 wherein the handle portion is located generally in the same plane as the teeth and the frame member and extends at an angle from the first end of the frame member in the direction that the teeth extend away from the frame member, and with the handle portion being at an angle to the teeth which is generally less than 90 degrees.

5. The comb of claim 4 wherein the handle portion is generally at a 45 degree angle to the teeth.

6. The comb of claim 4 wherein the means for introducing the treatment solution to the troughs comprises, in combination: a fluid conduit located internally of the frame member; fluid passageways extending between the troughs and the fluid conduit for providing fluid communication between the troughs and the fluid conduit, with the handle portion including a fluid container in fluid communication with the fluid conduit; and means for forcing hair treatment solution from the fluid container into the fluid conduit and the fluid passageways into the troughs.

7. The comb of claim 6 wherein the fluid container and the hair treatment solution forcing means comprises, in combination: a bottle including flexible portions for squeezing by the hand of the operator.

8. The comb of claim 3 further comprising, in combination: means attached to the second end of the frame member for picking up, raising, and/or separating hair from the scalp.

9. The comb of claim 8 wherein the picking up means comprises, in combination: an elongated spike shaped member formed as a continuation of the frame member beyond its second end.

10. The comb of claim 3 wherein the width of the gap is generally equal to twice the width of the teeth and twice the spacing of the teeth in the plurality of teeth; and wherein the width of the trough is generally equal to twice the width of the teeth.

11. The comb of claim 10 wherein the troughs have a generally parabolic shape in the plane of the teeth, with the closed end portion of the parabolic shape extending into the frame member and the open end portion of the parabolic shape extending in the direction of the teeth for enhancing the introduction and capturing of strands of hair into the troughs; and wherein the troughs are dish shaped in a plane generally perpendicular to the longitudinal axis of the frame member for enhancing the hair treatment solution pool formation ability.

12. The comb of claim 3 further comprising, in combination: means formed in the gaps between the groups of teeth for assisting the hair separation and capturing, solution pooling, and dispersing means.

13. The comb of claim 12 wherein the assisting means comprises, in combination: teeth extending generally perpendicular to the frame member and located generally centrally of the gap between the groups of teeth, with the assisting teeth including trough continuation members.

14. The comb of claim 13 wherein the assisting teeth have a width generally equal to twice the width of the first type of teeth and a length which is generally equal to the length of the first type of teeth; and with the assisting teeth having a generally constant height throughout its length which is generally equal to one half of the height of the first type of teeth at their attachment to the frame member for providing advantageous separation and capturing of the desired size of hair strands.

15. The comb of claim 14 wherein the trough continuation members have a generally angled shape in the plane of the first type of teeth, with the point of the angled shape being adjacent but spaced from the free points of the assisting teeth and with the open end of the angled shape extending towards and terminating contiguously in the troughs of the frame member; and wherein the trough continuation members are dish shaped in a plane generally perpendicular to the longitudinal axis of the frame member for enhancing the hair treatment solution pool formation ability.

16. The comb of claim 15 wherein the means for introducing the treatment solution to the troughs comprises, in combination: a fluid conduit located internally of the frame member; fluid passageways extending between the troughs and the fluid conduit for providing fluid communication between the troughs and the fluid conduit, with the handle portion including a fluid container in fluid communication with the fluid conduit; and means for forcing hair treatment solution from the fluid container into the fluid conduit and the fluid passageways into the troughs.

17. The comb of claim 16 wherein the fluid container and the hair treatment solution forcing means comprises, in combination: a bottle including flexible portions for squeezing by the hand of the operator.

* * * * *